US011490476B2

(12) United States Patent
Hsia

(10) Patent No.: US 11,490,476 B2
(45) Date of Patent: Nov. 1, 2022

(54) SOLID-STATE LIGHTING WITH A LUMINAIRE DIMMING DRIVER

(71) Applicant: Aleddra Inc., Renton, WA (US)

(72) Inventor: Chungho Hsia, Bellevue, WA (US)

(73) Assignee: Aleddra Inc., Renton, WA (US)

( * ) Notice: Subject to any disclaimer, the term of this patent is extended or adjusted under 35 U.S.C. 154(b) by 0 days.

(21) Appl. No.: 17/735,002

(22) Filed: May 2, 2022

(65) Prior Publication Data

US 2022/0264712 A1 Aug. 18, 2022

Related U.S. Application Data

(63) Continuation-in-part of application No. 17/717,838, filed on Apr. 11, 2022, which is a continuation-in-part of application No. 17/696,780, filed on Mar. 16, 2022, which is a continuation-in-part of application No. 17/405,203, filed on Aug. 18, 2021, now Pat. No. 11,283,291, which is a continuation-in-part of application No. 17/329,018, filed on May 24, 2021, now Pat. No. 11,303,151, and a continuation-in-part of application No. 17/313,988, filed on May 6, 2021, now Pat. No. 11,264,831, which is a continuation-in-part of application No. 17/213,519, filed on Mar. 26, 2021, now Pat. No. 11,271,422, which is a continuation-in-part of application No.

(Continued)

(51) Int. Cl.

| | |
|---|---|
| ***H05B 41/00*** | (2006.01) |
| ***H05B 45/10*** | (2020.01) |
| ***H05B 45/325*** | (2020.01) |

(52) U.S. Cl.
CPC ..... *H05B 45/10* (2020.01); *H05B 45/325* (2020.01)

(58) Field of Classification Search
CPC ..... H05B 45/10; H05B 45/325; H05B 45/30; H05B 45/37; H05B 45/38; H05B 47/17; Y02B 20/30; H02J 7/00714; H02J 9/065
USPC ..... 362/183, 249.02, 249.03
See application file for complete search history.

(56) References Cited

U.S. PATENT DOCUMENTS 7,453,217 B2 * 11/2008 Lys ..... H05B 45/20 315/312
2011/0121654 A1 * 5/2011 Recker ..... H05B 45/3725 307/64

(Continued)

*Primary Examiner* — Omar Rojas Cadima
(74) *Attorney, Agent, or Firm* — Han IP PLLC; Andy M. Han

(57) ABSTRACT

A light-emitting diode (LED) luminaire dimming driver comprises a power supply circuit, a dimming interface circuit, an optocoupler circuit, an LED luminaire driving circuit, and a supplied voltage control circuit. The LED luminaire driving circuit is configured to automatically convert a constant voltage from the power supply circuit into an output DC voltage to dim an external LED luminaire in response to a dimming signal no matter whether the external LED luminaire is originally dimmable or not. The LED luminaire driving circuit is further configured to receive a pulse-width modulation (PWM) signal and to control a magnitude of the output DC voltage in response to the PWM signal. The supplied voltage control circuit comprises a relay switch configured to sense the dimming signal, to control switching between a line voltage from AC mains and the output DC voltage to operate the external LED luminaire without operational ambiguity.

20 Claims, 4 Drawing Sheets

Related U.S. Application Data

17/151,606, filed on Jan. 18, 2021, now Pat. No. 11,259,386, which is a continuation-in-part of application No. 17/122,942, filed on Dec. 15, 2020, now Pat. No. 11,265,991, which is a continuation-in-part of application No. 17/099,450, filed on Nov. 16, 2020, now Pat. No. 11,264,830, which is a continuation-in-part of application No. 17/067,748, filed on Oct. 21, 2020, now Pat. No. 11,271,388, which is a continuation-in-part of application No. 17/026,903, filed on Sep. 21, 2020, now Pat. No. 11,271,421, which is a continuation-in-part of application No. 17/016,296, filed on Sep. 9, 2020, now Pat. No. 11,259,374, which is a continuation-in-part of application No. 16/989,016, filed on Aug. 10, 2020, now Pat. No. 11,122,658, which is a continuation-in-part of application No. 16/929,540, filed on Jul. 15, 2020, now Pat. No. 11,116,057, which is a continuation-in-part of application No. 16/904,206, filed on Jun. 17, 2020, now Pat. No. 11,102,864, which is a continuation-in-part of application No. 16/880,375, filed on May 21, 2020, now Pat. No. 11,172,551, which is a continuation-in-part of application No. 16/861,137, filed on Apr. 28, 2020, now Pat. No. 10,992,161, which is a continuation-in-part of application No. 16/830,198, filed on Mar. 25, 2020, now Pat. No. 10,869,373, which is a continuation-in-part of application No. 16/735,410, filed on Jan. 6, 2020, now Pat. No. 10,660,179, which is a continuation-in-part of application No. 16/694,970, filed on Nov. 25, 2019, now Pat. No. 10,602,597, which is a continuation-in-part of application No. 16/681,740, filed on Nov. 12, 2019, now Pat. No. 10,959,310, which is a continuation-in-part of application No. 16/664,034, filed on Oct. 25, 2019, now Pat. No. 10,660,184, which is a continuation-in-part of application No. 16/572,040, filed on Sep. 16, 2019, now Pat. No. 10,645,782, which is a continuation-in-part of application No. 16/547,502, filed on Aug. 21, 2019, now Pat. No. 10,485,073, which is a continuation-in-part of application No. 16/530,747, filed on Aug. 2, 2019, now Pat. No. 10,492,265, which is a continuation-in-part of application No. 16/458,823, filed on Jul. 1, 2019, now Pat. No. 10,485,065, which is a continuation-in-part of application No. 16/432,735, filed on Jun. 5, 2019, now Pat. No. 10,390,396, which is a continuation-in-part of application No. 16/401,849, filed on May 2, 2019, now Pat. No. 10,390,395, which is a continuation-in-part of application No. 16/296,864, filed on Mar. 8, 2019, now Pat. No. 10,390,394, which is a continuation-in-part of application No. 16/269,510, filed on Feb. 6, 2019, now Pat. No. 10,314,123, which is a continuation-in-part of application No. 16/247,456, filed on Jan. 14, 2019, now Pat. No. 10,327,298, which is a continuation-in-part of application No. 16/208,510, filed on Dec. 3, 2018, now Pat. No. 10,237,946, which is a continuation-in-part of application No. 16/154,707, filed on Oct. 8, 2018, now Pat. No. 10,225,905, which is a continuation-in-part of application No. 15/947,631, filed on Apr. 6, 2018, now Pat. No. 10,123,388, which is a continuation-in-part of application No. 15/911,086, filed on Mar. 3, 2018, now Pat. No. 10,136,483, which is a continuation-in-part of application No. 15/897,106, filed on Feb. 14, 2018, now Pat. No. 10,161,616, which is a continuation-in-part of application No. 15/874,752, filed on Jan. 18, 2018, now Pat. No. 10,036,515, which is a continuation-in-part of application No. 15/836,170, filed on Dec. 8, 2017, now Pat. No. 10,021,753, which is a continuation-in-part of application No. 15/649,392, filed on Jul. 13, 2017, now Pat. No. 9,986,619, which is a continuation-in-part of application No. 15/444,536, filed on Feb. 28, 2017, now Pat. No. 9,826,595, which is a continuation-in-part of application No. 15/362,772, filed on Nov. 28, 2016, now Pat. No. 9,967,927, which is a continuation-in-part of application No. 15/225,748, filed on Aug. 1, 2016, now Pat. No. 9,743,484, which is a continuation-in-part of application No. 14/818,041, filed on Aug. 4, 2015, now Pat. No. 9,420,663, which is a continuation-in-part of application No. 14/688,841, filed on Apr. 16, 2015, now Pat. No. 9,288,867, which is a continuation-in-part of application No. 14/465,174, filed on Aug. 21, 2014, now Pat. No. 9,277,603, which is a continuation-in-part of application No. 14/135,116, filed on Dec. 19, 2013, now Pat. No. 9,163,818, which is a continuation-in-part of application No. 13/525,249, filed on Jun. 15, 2012, now Pat. No. 8,749,167.

(56) References Cited

U.S. PATENT DOCUMENTS

| | | | | |
|---|---|---|---|---|
| 2013/0147376 | A1* | 6/2013 | Trainor | H02J 9/065 315/240 |
| 2015/0208469 | A1* | 7/2015 | Coetzee | H02M 1/36 315/307 |

* cited by examiner

SOLID-STATE LIGHTING WITH A LUMINAIRE DIMMING DRIVER

CROSS-REFERENCE TO RELATED APPLICATIONS

The present disclosure is part of a continuation-in-part (CIP) application of U.S. patent application Ser. No. 17/717,838, filed 11 Apr. 2022, which is part of CIP application of U.S. patent application Ser. No. 17/696,780, filed 16 Mar. 2022, which is part of CIP application of U.S. patent application Ser. No. 17/405,203, filed 18 Aug. 2021 and issued as U.S. Pat. No. 11,283,291 on 22 Mar. 2022, which is part of CIP application of U.S. patent application Ser. No. 17/329,018, filed 24 May 2021 and issued as U.S. Pat. No. 11,303,151 on 12 Apr. 2022, which is part of CIP application of U.S. patent application Ser. No. 17/313,988, filed 6 May 2021 and issued as U.S. Pat. No. 11,264,831 on 1 Mar. 2022, which is part of CIP application of U.S. patent application Ser. No. 17/213,519, filed 26 Mar. 2021 and issued as U.S. Pat. No. 11,271,422 on 8 Mar. 2022, which is part of CIP application of U.S. patent application Ser. No. 17/151,606, filed 18 Jan. 2021 and issued as U.S. Pat. No. 11,259,386 on 22 Feb. 2022, which is part of CIP application of U.S. patent application Ser. No. 17/122,942, filed 15 Dec. 2020 and issued as U.S. Pat. No. 11,265,991 on 1 Mar. 2022, which is part of CIP application of U.S. patent application Ser. No. 17/099,450, filed 16 Nov. 2020 and issued as U.S. Pat. No. 11,264,830 on 1 Mar. 2022, which is part of CIP application of U.S. patent application Ser. No. 17/076,748, filed 21 Oct. 2020 and issued as U.S. Pat. No. 11,271,388 on 8 Mar. 2022, which is part of CIP application of U.S. patent application Ser. No. 17/026,903, filed 21 Sep. 2020 and issued as U.S. Pat. No. 11,271,421 on 8 Mar. 2022, which is part of CIP application of U.S. patent application Ser. No. 17/016,296, filed 9 Sep. 2020 and issued as U.S. Pat. No. 11,259,374 on 22 Feb. 2022, which is part of CIP application of U.S. patent application Ser. No. 16/989,016, filed 10 Aug. 2020 and issued as U.S. Pat. No. 11,122,658 on 14 Sep. 2021, which is part of CIP application of U.S. patent application Ser. No. 16/929,540, filed 15 Jul. 2020 and issued as U.S. Pat. No. 11,116,057 on 7 Sep. 2021, which is part of CIP application of U.S. patent application Ser. No. 16/904,206, filed 17 Jun. 2020 and issued as U.S. Pat. No. 11,102,864 on 24 Aug. 2021, which is part of CIP application of U.S. patent application Ser. No. 16/880,375, filed 21 May 2020 and issued as U.S. Pat. No. 11,172,551 on 9 Nov. 2021, which is part of CIP application of U.S. patent application Ser. No. 16/861,137, filed 28 Apr. 2020 and issued as U.S. Pat. No. 10,992,161 on 27 Apr. 2021, which is part of CIP application of U.S. patent application Ser. No. 16/830,198, filed 25 Mar. 2020 and issued as U.S. Pat. No. 10,869,373 on 15 Dec. 2020, which is part of CIP application of U.S. patent application Ser. No. 16/735,410, filed 6 Jan. 2020 and issued as U.S. Pat. No. 10,660,179 on 19 May 2020, which is part of CIP application of U.S. patent application Ser. No. 16/694,970, filed 25 Nov. 2019 and issued as U.S. Pat. No. 10,602,597 on 24 Mar. 2020, which is part of CIP application of U.S. patent application Ser. No. 16/681,740, filed 12 Nov. 2019 and issued as U.S. Pat. No. 10,959,310 on 23 Mar. 2021, which is part of CIP application of U.S. patent application Ser. No. 16/664,034, filed 25 Oct. 2019 and issued as U.S. Pat. No. 10,660,184 on 19 May 2020, which is part of CIP application of U.S. patent application Ser. No. 16/572,040, filed 16 Sep. 2019 and issued as U.S. Pat. No. 10,645,782 on 5 May 2020, which is part of CIP application of U.S. patent application Ser. No. 16/547,502, filed 21 Aug. 2019 and issued as U.S. Pat. No. 10,485,073 on 19 Nov. 2019, which is part of CIP application of U.S. patent application Ser. No. 16/530,747, filed 2 Aug. 2019 and issued as U.S. Pat. No. 10,492,265 on 26 Nov. 2019, which is part of CIP application of U.S. patent application Ser. No. 16/458,823, filed 1 Jul. 2019 and issued as U.S. Pat. No. 10,485,065 on 19 Nov. 2019, which is part of CIP application of U.S. patent application Ser. No. 16/432,735, filed 5 Jun. 2019 and issued as U.S. Pat. No. 10,390,396 on 20 Aug. 2019, which is part of CIP application of U.S. patent application Ser. No. 16/401,849, filed 2 May 2019 and issued as U.S. Pat. No. 10,390,395 on 20 Aug. 2019, which is part of CIP application of U.S. patent application Ser. No. 16/296,864, filed 8 Mar. 2019 and issued as U.S. Pat. No. 10,390,394 on 20 Aug. 2019, which is part of CIP application of U.S. patent application Ser. No. 16/269,510, filed 6 Feb. 2019 and issued as U.S. Pat. No. 10,314,123 on 4 Jun. 2019, which is part of CIP application of U.S. patent application Ser. No. 16/247,456, filed 14 Jan. 2019 and issued as U.S. Pat. No. 10,327,298 on 18 Jun. 2019, which is part of CIP application of U.S. patent application Ser. No. 16/208,510, filed 3 Dec. 2018 and issued as U.S. Pat. No. 10,237,946 on 19 Mar. 2019, which is part of CIP application of U.S. patent application Ser. No. 16/154,707, filed 8 Oct. 2018 and issued as U.S. Pat. No. 10,225,905 on 5 Mar. 2019, which is part of a CIP application of U.S. patent application Ser. No. 15/947,631, filed 6 Apr. 2018 and issued as U.S. Pat. No. 10,123,388 on 6 Nov. 2018, which is part of a CIP application of U.S. patent application Ser. No. 15/911,086, filed 3 Mar. 2018 and issued as U.S. Pat. No. 10,136,483 on 20 Nov. 2018, which is part of a CIP application of U.S. patent application Ser. No. 15/897,106, filed 14 Feb. 2018 and issued as U.S. Pat. No. 10,161,616 on 25 Dec. 2018, which is a CIP application of U.S. patent application Ser. No. 15/874,752, filed 18 Jan. 2018 and issued as U.S. Pat. No. 10,036,515 on 31 Jul. 2018, which is a CIP application of U.S. patent application Ser. No. 15/836,170, filed 8 Dec. 2017 and issued as U.S. Pat. No. 10,021,753 on 10 Jul. 2018, which is a CIP application of U.S. patent application Ser. No. 15/649,392 filed 13 Jul. 2017 and issued as U.S. Pat. No. 9,986,619 on 29 May 2018, which is a CIP application of U.S. patent application Ser. No. 15/444,536, filed 28 Feb. 2017 and issued as U.S. Pat. No. 9,826,595 on 21 Nov. 2017, which is a CIP application of U.S. patent application Ser. No. 15/362,772, filed 28 Nov. 2016 and issued as U.S. Pat. No. 9,967,927 on 8 May 2018, which is a CIP application of U.S. patent application Ser. No. 15/225,748, filed 1 Aug. 2016 and issued as U.S. Pat. No. 9,743,484 on 22 Aug. 2017, which is a CIP application of U.S. patent application Ser. No. 14/818,041, filed 4 Aug. 2015 and issued as U.S. Pat. No. 9,420,663 on 16 Aug. 2016, which is a CIP application of U.S. patent application Ser. No. 14/688,841, filed 16 Apr. 2015 and issued as U.S. Pat. No. 9,288,867 on 15 Mar. 2016, which is a CIP application of U.S. patent application Ser. No. 14/465,174, filed 21 Aug. 2014 and issued as U.S. Pat. No. 9,277,603 on 1 Mar. 2016, which is a CIP application of U.S. patent application Ser. No. 14/135,116, filed 19 Dec. 2013 and issued as U.S. Pat. No. 9,163,818 on 20 Oct. 2015, which is a CIP application of U.S. patent application Ser. No. 13/525,249, filed 15 Jun. 2012 and issued as U.S. Pat. No. 8,749,167 on 10 Jun. 2014. Contents of the above-identified applications are incorporated herein by reference in their entirety.

BACKGROUND

Technical Field

The present disclosure relates to light-emitting diode (LED) luminaire dimming drivers and more particularly to an LED luminaire driver controllable by a low-voltage dimming controller to regulate output power of the LED luminaire according to a dimming signal of the low-voltage dimming controller without flickering.

Description of the Related Art

Solid-state lighting from semiconductor LEDs has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, the potential health concerns such as temporal light artifacts become especially important and need to be well addressed.

In today's retrofit application of an LED luminaire to replace an existing fluorescent luminaire, consumers may choose either to adopt a ballast-compatible luminaire with an existing ballast used to operate the fluorescent luminaire or to employ an alternate current (AC) mains-operable LED luminaire by removing/bypassing the ballast. Either application has its advantages and disadvantages. In the former case, although the ballast consumes extra power, it is straightforward to replace the fluorescent luminaire without rewiring, which consumers have a first impression that it is the best alternative to the fluorescent luminaire. But the fact is that total cost of ownership for this approach is high regardless of very low initial cost. For example, the ballast-compatible luminaire works only with particular types of ballasts. If the existing ballast is not compatible with the ballast-compatible luminaire, the consumer will have to replace the ballast. Some facilities built long time ago incorporate different types of fixtures, which requires extensive labor for both identifying ballasts and replacing incompatible ones. Moreover, a ballast-compatible luminaire can operate longer than the ballast. When an old ballast fails, a new ballast will be needed to replace in order to keep the ballast-compatible luminaire working. Maintenance will be complicated, sometimes for the luminaires and sometimes for the ballasts. The incurred cost will preponderate over the initial cost savings by changeover to the ballast-compatible luminaire for hundreds of fixtures throughout a facility. When the ballast in a fixture dies, all the ballast-compatible luminaires in the fixture go out until the ballast is replaced. In addition, replacing a failed ballast requires a certified electrician. The labor costs and long-term maintenance costs will be unacceptable to end users. From energy saving point of view, the ballast constantly draws power, even when the ballast-compatible luminaires are dead or not installed. In this sense, any energy saved while using the ballast-compatible luminaire becomes meaningless with the constant energy use by the ballast. In the long run, the ballast-compatible luminaires are more expensive and less efficient than self-sustaining AC mains-operable luminaires.

On the contrary, an AC mains-operable luminaire does not require the ballast to operate. Before use of the AC mains-operable luminaire, the ballast in a fixture must be removed or bypassed. Removing or bypassing the ballast does not require an electrician and can be replaced by end users. Each AC mains-operable luminaire is self-sustaining. If one AC mains-operable luminaire in a fixture goes out, other luminaires or lamps in the fixture are not affected. Once installed, the AC mains-operable luminaire will only need to be replaced after 50,000 hours.

Light dimming can provide many benefits such as helping create an atmosphere by adjusting light levels, which reduces energy consumption and increases operating life of an LED lighting luminaire. Light dimmers are devices coupled to the lighting luminaire and used to lower the brightness of light. By changing the voltage waveform applied to the LED lighting luminaire, it is possible to lower the intensity of the light output, so called light dimming. Modern light dimmers are based on four dimming protocols, namely, mains dimming, DALI (Digital Addressable Lighting Interface), DMX (Digital Multiplex), and analog dimming, among which both DALI and DMX need a transmitter and a receiver. The analog dimming uses a direct current (DC) signal (0-10 V) between a control panel and an LED driver. As the signal voltage changes, the light output changes. However, the analog dimming needs an extra wire on a single channel basis when installed in a dimming system. Mains dimming, the oldest dimming protocol, is a type that can still widely be seen in homes, schools, and many other commercial places. A mains dimming system relies on reducing an input voltage to the LED lighting luminaire, typically by 'chopping-out' part of a line voltage from the AC mains, a so called phase-cut line voltage. There is no need to install the extra wire in an area that requires light dimming. However, the LED luminaire with a driver controllable by a mains dimmer (i.e., a power-line dimmer) needs a special filter design and exists an inherent drawback such as an incompatibility between the power-line dimmer and the LED luminaire, which causes possible flickering of the LED luminaire. The analog dimming using a low-voltage DC signal between the control panel and the LED driver does not have any compatibility issue. Nevertheless, almost all of LED luminaires already installed in industries do not comprise any analog dimming ports and are regarded as non-dimmable. The market requires a general-purpose dimming driver that can be used to convert all of LED luminaires that are originally designed as non-dimmable into dimmable ones. In this disclosure, such a general-purpose dimming driver configured to automatically convert a constant voltage from a power supply circuit into an output DC voltage to dim an external LED luminaire in response to a dimming signal will be addressed.

SUMMARY

An LED luminaire dimming driver comprises a primary power supply circuit, an LED luminaire driving circuit, and a supplied voltage control circuit. The primary power supply circuit is configured to generate a first DC voltage. The LED luminaire driving circuit is configured to automatically convert the first DC voltage into an output DC voltage to drive an external LED luminaire in response to a dimming signal no matter whether the external LED luminaire is originally designed as dimmable or not. The LED luminaire driving circuit is further configured to receive a pulse-width modulation (PWM) signal and to control a magnitude of the output DC voltage in response to the PWM signal. The supplied voltage control circuit comprises a relay switch configured to sense the dimming signal, to control switching between a line voltage from AC mains and the output DC voltage to operate the external LED luminaire without operational ambiguity.

The LED luminaire dimming driver further comprises two electrical conductors, "L" and "N", configured to receive the line voltage. The primary power supply circuit is coupled to the two electrical conductors and configured to generate the first DC voltage. The LED luminaire driving circuit comprises a first converter circuit and an optocoupler circuit configured to control the first converter circuit in response to the dimming signal received from an external low-voltage dimming controller. The LED luminaire driving circuit is configured to convert the first DC voltage into the output DC voltage with a regulated output current. The relay switch comprises a coil and is configured to relay either the line voltage or the output DC voltage to the external LED luminaire to operate thereof.

The relay switch further comprises a first pair of input electrical terminals, a second pair of input electrical terminals, a third pair of input electrical terminals, and a pair of output electrical terminals. The third pair of input electrical terminals are configured to receive a pick-up voltage to operate the coil. The first pair of input electrical terminals are configured to receive line voltage whereas the second pair of input electrical terminals are configured to receive the output DC voltage. The optocoupler circuit comprises an optocoupler comprising an infrared emitting diode and a phototransistor configured to receive optical signals emitting from the infrared emitting diode. The optocoupler circuit is configured to operate in response to the dimming signal and to subsequently enable the relay switch to relay the output DC voltage to the pair of output electrical terminals and to operate the external LED luminaire when the dimming signal is present. The optocoupler circuit is further configured to produce a first PWM signal via a port. The supplied voltage control circuit further comprises a primary control circuit configured to produce both an analog signal via a first link and a second PWM signal via a second link in response to the first PWM signal. The second PWM signal is configured to control the first converter circuit. The optocoupler circuit further comprises an interface circuit configured to receive the dimming signal from the external low-voltage dimming controller via a third link and to communicate with the primary control circuit via the optocoupler. The supplied voltage control circuit further comprises a first transistor circuit configured to receive the analog signal and to control the pick-up voltage to appear at the third pair of input electrical terminals. Specifically, the analog signal pulls down a voltage at the port via the first transistor circuit. The coil senses a potential difference between the third pair of input electrical terminals. When the pick-up voltage appears at the third pair of input electrical terminals, the coil is operating. The first converter circuit is further configured to set up the output DC voltage with the regulated output current proportional to an input rated current of the external LED luminaire in response to the dimming signal. When the coil operates, the output DC voltage across the port is delivered to the pair of output electrical terminals. When the dimming signal is not present, the analog signal remains a low level, and the pick-up voltage does not appear at the third pair of input electrical terminals. In this case, the coil remains normally off, and the line voltage from the first pair of input electrical terminals is delivered to the pair of output electrical terminals to consequently operate the external LED luminaire.

The primary power supply circuit comprises a control device and a second converter circuit controlled by the control device and configured to generate the first DC voltage higher than a maximum input operating voltage of the second converter circuit. The first DC voltage appears at an output port of the second converter circuit with respect to a first ground reference. The first converter circuit is configured to receive both the first DC voltage from the output port and the second PWM signal via the second link and to regulate the output DC voltage less than the first DC voltage with the regulated output current to operate the external LED luminaire in response to the second PWM signal. The second converter circuit comprises a first electronic switch, one or more first capacitors, one or more first switching diodes, and a first inductor connecting in front of the first electronic switch. The first electronic switch is configured to turn on and off to respectively charge and discharge the first inductor and to regulate the first DC voltage at a constant voltage. The one or more first switching diodes may comprise a plurality of diodes connected in parallel to accommodate a high current. The one or more first capacitors may comprise a plurality of capacitors connected in parallel for better filtering. In the second converter circuit, there may have a first sensing resistor to monitor an electric current to flow into the first electronic switch and to feedback to the control device to control an operation of the second converter circuit.

The first converter circuit is further configured to regulate the output DC voltage equal to or greater than a minimum input operating voltage of the external LED luminaire to operate thereof when the dimming signal is present. Each time when the dimming signal is changed, the relay switch is controlled to deliver the output DC voltage to operate the external LED luminaire in response to the dimming signal that is changed. The first converter circuit comprises a second electronic switch, one or more second capacitors, one or more second switching diodes, and a second inductor connecting between the one or more second capacitors and the second electronic switch. The second electronic switch is configured to turn on and off to respectively charge and discharge the second inductor and to regulate the output DC voltage with the regulated output current to operate the external LED luminaire with a dimmable output light. The second electronic switch is further configured to be turned on according to a pulse width of the second PWM signal and a switching frequency. The pulse width of the second PWM signal comprises a range of pulse widths from a narrowest pulse width to a widest pulse width all proportional to a voltage level of the dimming signal. The narrowest pulse width is in response to a dimmest dimming signal that is referred to as a lowest voltage level of the dimming signal that produces a dimmest lighting luminance. The switching frequency is configured to operate at a predetermined value. The first converter circuit further comprises a second transistor circuit comprising one or more second transistors configured to build up a switching control signal via a port to turn on the second electronic switch and to enable the first converter circuit when the dimming signal is present, thereby producing the output DC voltage in response to the second PWM signal. The first converter circuit further comprises a second sensing resistor configured to monitor an operation of the first converter circuit and to support building up the switching control signal to operate the first converter circuit. The one or more second switching diodes may comprise a plurality of diodes connected in parallel to accommodate a high current. The one or more second capacitors may comprise a plurality of capacitors connected in parallel for better filtering.

The LED luminaire dimming driver further comprises a secondary power supply circuit configured to down-convert the first DC voltage into a second DC voltage at a port with respect to the first ground reference to supply a power to the pick-up voltage for the coil and to build up the switching control signal that has an amplitude close to the second DC voltage. The LED luminaire dimming driver further comprises a tertiary power supply circuit configured to down-convert the second DC voltage into a third DC voltage at a port with respect to the first ground reference to supply a power to the primary control circuit and the optocoupler, thereby sustaining the analog signal, the first PWM signal, and the second PWM signal. Note that the one or more second transistors in the first converter circuit are further configured to up-convert the second PWM signal received into the switching control signal with the amplitude close to the second DC voltage, thereby expediting switching of the second electronic switch and producing the output DC voltage in response to the switching control signal. The optocoupler circuit may further comprise a resistor connecting the third DC voltage to the phototransistor so that the first PWM signal can be transmitted to the primary control circuit. The primary power supply circuit further comprises a third inductor magnetically coupled to the first inductor but electrically isolated from the first inductor. The third inductor is configured to produce a fourth DC voltage via a rectifier diode with respect to a second ground reference to supply a power to the interface circuit and the infrared emitting diode, thereby allowing transmission of the dimming signal between the external low-voltage dimming controller and the primary control circuit and maintaining a circuit isolation between the two. The fourth DC voltage is built up with a current flowing through the infrared emitting diode, thereby transferring a high-level voltage signal with the first PWM signal to the phototransistor. The high-level voltage signal enables the primary control circuit, thereby operating the first converter circuit and the coil. The external low-voltage dimming signal comprises a nominal 0-to-10-volt signal or a nominal 1-to-10-volt signal, where a lowest voltage signal controls the external LED luminaire to emit the dimmest (lowest) lighting luminance, and a highest voltage signal controls the external LED luminaire to emit a brightest lighting luminance. In this disclosure, the dimmest dimming signal means a signal with the lowest dimming voltage.

BRIEF DESCRIPTION OF THE DRAWINGS

Non-limiting and non-exhaustive embodiments of the present disclosure are described with reference to the following figures, wherein like names refer to like parts but their reference numerals differ throughout the various figures unless otherwise specified. Moreover, in the section of detailed description of the invention, any of a "primary", a "secondary", a "tertiary", a "first", a "second", a "third", and so forth does not necessarily represent a part that is mentioned in an ordinal manner, but a particular one.

DETAILED DESCRIPTION OF VARIOUS EMBODIMENTS

Figure 1:
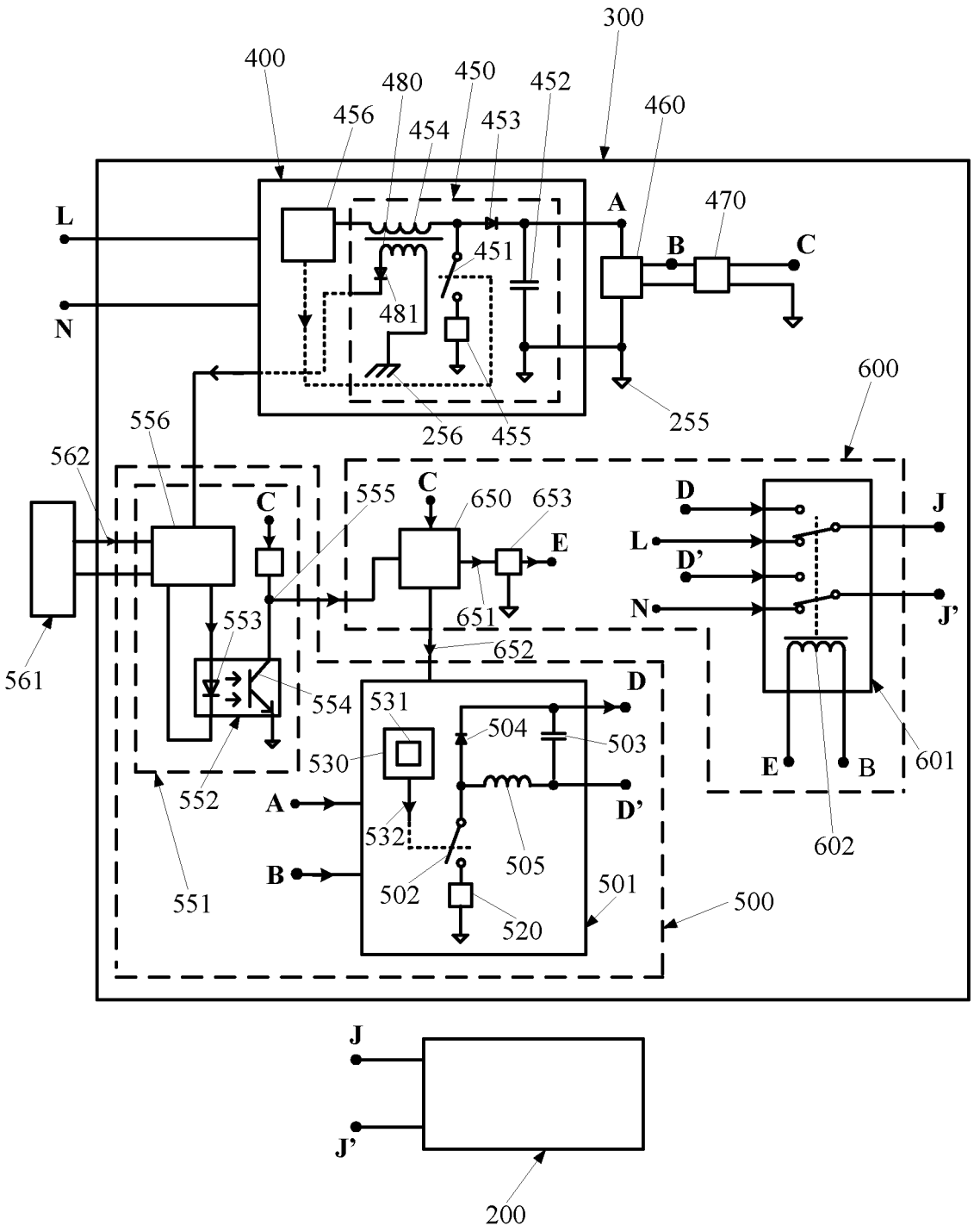
FIG. 1 is a block diagram of an LED luminaire dimming driver according to the present disclosure.

FIG. 1 is a block diagram of an LED luminaire dimming driver according to the present disclosure. The LED luminaire dimming driver 300 comprises a primary power supply circuit 400, an LED luminaire driving circuit 500, and a supplied voltage control circuit 600. The primary power supply circuit 400 is configured to generate a first DC voltage. The LED luminaire driving circuit 500 is configured to automatically convert the first DC voltage into an output DC voltage to drive an external LED luminaire 200 in presence of a dimming signal no matter whether the external LED luminaire 200 is originally designed as dimmable or not. The LED luminaire driving circuit 500 is further configured to receive a PWM signal and to control a magnitude of the output DC voltage in response to the PWM signal. The supplied voltage control circuit 600 comprises a relay switch 601 configured to sense the dimming signal, to control switching between a line voltage from the AC mains and the output DC voltage to operate the external LED luminaire 200 without operational ambiguity.

In FIG. 1, the LED luminaire dimming driver 300 further comprises two electrical conductors, "L" and "N", configured to receive the line voltage. The primary power supply circuit 400 is coupled to the two electrical conductors and configured to generate the first DC voltage via a full-wave rectifier (not shown). The LED luminaire driving circuit 500 comprises a first converter circuit 501 and an optocoupler circuit 551 configured to control the first converter circuit 501 in response to the dimming signal received from an external low-voltage dimming controller 561. The LED luminaire driving circuit 500 is configured to convert the first DC voltage into the output DC voltage with a regulated output current. The relay switch 601 comprises a coil 602 and is configured to relay either the line voltage or the output DC voltage to the external LED luminaire 200 to operate thereof.

The relay switch 601 further comprises a first pair of input electrical terminals denoted as "L" and "N", a second pair of input electrical terminals denoted as "D" and "D'", a third pair of input electrical terminals denoted as "B" and "E", and a pair of output electrical terminals denoted as "J" and "J'". The third pair of input electrical terminals ("B" and "E") are configured to receive a pick-up voltage to operate the coil 602. The first pair of input electrical terminals ("L" and "N") are configured to receive line voltage whereas the second pair of input electrical terminals ("D" and "D'") are configured to receive the output DC voltage. The optocoupler circuit 551 comprises an optocoupler 552 comprising an infrared emitting diode 553 and a phototransistor 554 configured to receive optical signals emitting from the infrared emitting diode 553. The optocoupler circuit 551 is configured to operate in response to the dimming signal and to subsequently enable the relay switch 601 to relay the output DC voltage to the pair of output electrical terminals ("J" and "J'") and to operate the external LED luminaire 200 when the dimming signal is present. The optocoupler circuit 551 is further configured to produce a first PWM signal via a port 555. The supplied voltage control circuit 600 further comprises a primary control circuit 650 configured to produce both an analog signal via a first link 651 and a second PWM signal via a second link 652 in response to the first PWM signal. The second PWM signal is configured to control the first converter circuit 501. The optocoupler circuit 551 further comprises an interface circuit 556 configured to receive the dimming signal from the external low-voltage dimming controller 561 via a third link 562 and to communicate with the primary control circuit 650 via the optocoupler 552. The supplied voltage control circuit 600 further comprises a first transistor circuit 653 configured to receive the analog signal and to control the pick-up voltage to appear at the third pair of input electrical terminals ("B" and "E"). Specifically, the analog signal pulls down a voltage at the port "E" via the first transistor circuit 653. The coil 602 senses a potential difference between the third pair of input electrical terminals ("B" and "E"). When the pick-up voltage appears at the third pair of input electrical terminals ("B" and "E"), the coil 602 is operating. The first converter circuit 501 is further configured to set up the output DC voltage across a port "D" and "D'" with the regulated output current proportional to an input rated current of the external LED luminaire 200 in response to the dimming signal. When the coil 602 operates, the output DC voltage across the port "D" and "D'" is delivered to the pair of output electrical terminals ("J" and "J'"). When the dimming signal is not present, the analog signal remains a low level, and the pick-up voltage does not appear at the third pair of input electrical terminals ("B" and "E"). In this case, the coil 602 remains normally off, and the line voltage from the first pair of input electrical terminals ("L" and "N") is delivered to the pair of output electrical terminals ("J" and "J'") to consequently operate the external LED luminaire 200.

In FIG. 1, the primary power supply circuit 400 comprises a control device 456 and a second converter circuit 450 controlled by the control device 456 and configured to generate the first DC voltage higher than a maximum input operating voltage of the second converter circuit 450. The first DC voltage appears at an output port "A" of the second converter circuit 450 with respect to a first ground reference 255. The first converter circuit 501 is configured to receive both the first DC voltage from the output port "A" and the second PWM signal via the second link 652 and to regulate the output DC voltage less than the first DC voltage with the regulated output current to operate the external LED luminaire 200 in response to the second PWM signal. The second converter circuit 450 comprises a first electronic switch 451, one or more first capacitors 452, one or more first switching diodes 453, and a first inductor 454 connecting in front of the first electronic switch 451. The first electronic switch 451 is configured to turn on and off to respectively charge and discharge the first inductor 454 and to regulate the first DC voltage to be a constant voltage. The one or more first switching diodes 453 may comprise a plurality of diodes connected in parallel to accommodate a high current. The one or more first capacitors 452 may comprise a plurality of capacitors connected in parallel for better filtering. In the second converter circuit 450, there may have a sensing resistor 455 to monitor an operation of the second converter circuit 450 and to feedback to the control device 456.

In FIG. 1, the first converter circuit 501 is further configured to regulate the output DC voltage equal to or greater than a minimum input operating voltage of the external LED luminaire 200 to operate thereof when the dimming signal is present. Each time when the dimming signal is changed, the relay switch 601 is controlled to deliver the output DC voltage to operate the external LED luminaire 200 in response to the dimming signal that is changed. The first converter circuit 501 comprises a second electronic switch 502, one or more second capacitors 503, one or more second switching diodes 504, and a second inductor 505 connecting between the one or more second capacitors 503 and the second electronic switch 502. The second electronic switch 502 is configured to turn on and off to respectively charge and discharge the second inductor 505 and to regulate the output DC voltage with the regulated output current to operate the external LED luminaire 200 with a dimmable output light. The second electronic switch 502 is further configured to be turned on according to a pulse width of the second PWM signal and a switching frequency. The pulse width of the second PWM signal comprises a range of pulse widths from a narrowest pulse width to a widest pulse width all proportional to a voltage level of the dimming signal. The narrowest pulse width is in response to a dimmest dimming signal that is referred to as a lowest voltage level of the dimming signal that produces a dimmest lighting luminance. The switching frequency is configured to operate at a predetermined value. The first converter circuit 501 further comprises a second transistor circuit 530 comprising one or more second transistors 531 configured to build up a switching control signal via a port 532 to turn on the second electronic switch 502 and to enable the first converter circuit 501 when the dimming signal is present, thereby producing the output DC voltage in response to the second PWM signal. The first converter circuit 501 further comprises a second sensing resistor 520 configured to monitor an operation of the first converter circuit 501 and to support building up the switching control signal to operate the first converter circuit 501. The one or more second switching diodes 504 may comprise a plurality of diodes connected in parallel to accommodate a high current. The one or more second capacitors 503 may comprise a plurality of capacitors connected in parallel for better filtering.

In FIG. 1, the LED luminaire dimming driver 300 further comprises a secondary power supply circuit 460 configured to down-convert the first DC voltage into a second DC voltage at a port "B" with respect to the first ground reference 255 to supply a power to the pick-up voltage for the coil 602 and to build up the switching control signal that has an amplitude close to the second DC voltage. The LED luminaire dimming driver 300 further comprises a tertiary power supply circuit 470 configured to down-convert the second DC voltage into a third DC voltage at a port "C" with respect to the first ground reference 255 to supply a power to the primary control circuit 650 and the optocoupler 552, thereby sustaining the analog signal, the first PWM signal, and the second PWM signal. Note that the one or more second transistors 531 in the first converter circuit 501 are further configured to up-convert the second PWM signal received into the switching control signal with the amplitude close to the second DC voltage, thereby expediting switching of the second electronic switch 502 and producing the output DC voltage in response to the switching control signal. The optocoupler circuit 551 may further comprise a resistor 557 connecting the third DC voltage to the phototransistor 554 so that the first PWM signal can be transmitted to the primary control circuit 650. The primary power supply circuit 400 further comprises a third inductor 480 magnetically coupled to the first inductor 454 but electrically isolated from the first inductor 454. The third inductor 480 is configured to produce a fourth DC voltage via a rectifier diode 481 with respect to a second ground reference 256 to supply a power to the interface circuit 556 and the infrared emitting diode 553, thereby allowing transmission of the dimming signal between the external low-voltage dimming controller 561 and the primary control circuit 650 and maintaining a circuit isolation between the two. The fourth DC voltage is built up with a current flowing through the infrared emitting diode 553, thereby transferring a high-level voltage signal with the first PWM signal to the phototransistor 554. The high-level voltage signal enables the primary control circuit 650, thereby operating the first converter circuit 501 and the coil 602. The external low-voltage dimming signal comprises a nominal 0-to-10-volt signal or a nominal 1-to-10-volt signal, where a lowest voltage signal controls the external LED luminaire 200 to emit the dimmest (lowest) lighting luminance, and a highest voltage signal controls the external LED luminaire 200 to emit a brightest lighting luminance. In this disclosure, the dimmest dimming signal means a signal with the lowest dimming voltage.

Figure 2:
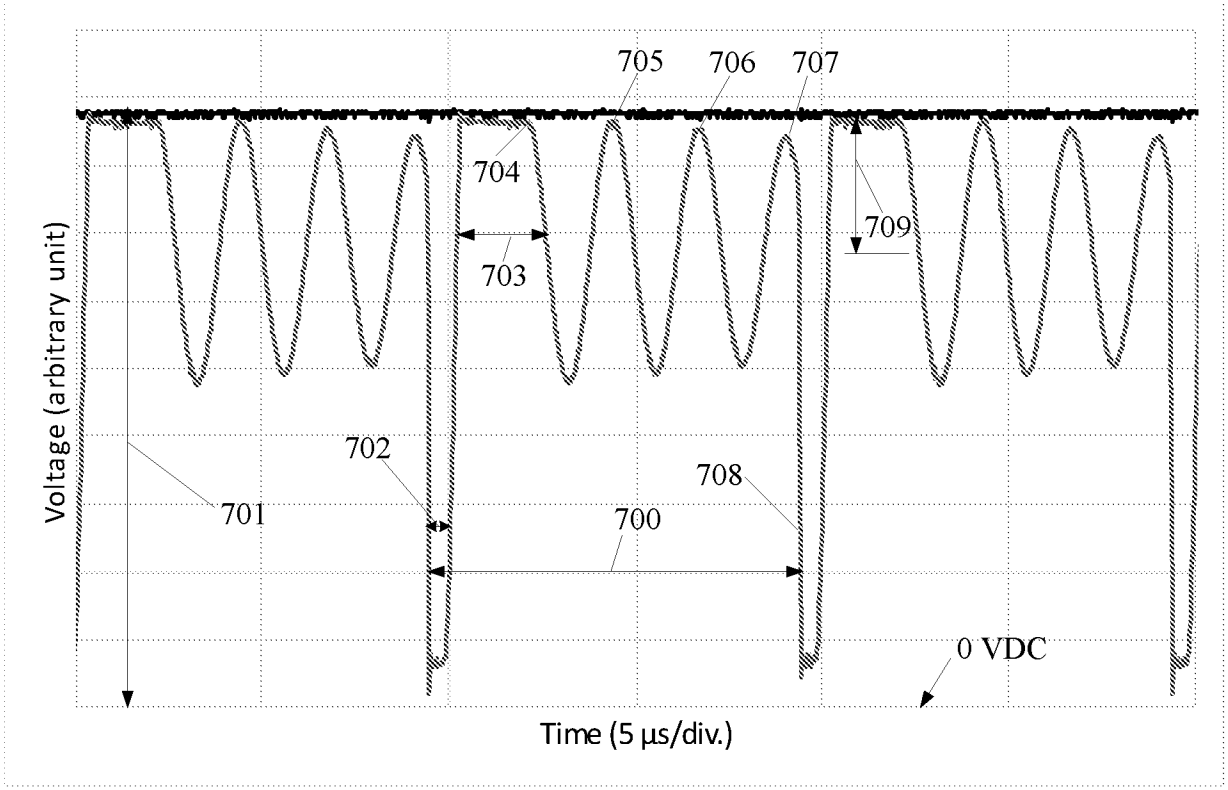
FIG. 2 is a first set of example waveforms measured at the second inductor according to the present disclosure.

FIG. 2 is a first set of example waveforms measured at the second inductor and the one or more second capacitors according to the present disclosure. Referring to FIG. 1, when the dimmest dimming signal is present, the primary control circuit 650 sends the second PWM signal to the first converter circuit 501. The second transistor circuit 530 is configured to build up the switching control signal to turn on the second electronic switch 502 and to enable the first converter circuit 501 to generate the output DC voltage in response to the second PWM signal corresponding to the dimmest dimming signal. In FIG. 2, a first trace having an amplitude 701 with respect to 0 volt (V) DC represents the first DC voltage with respect to the first ground reference 255, which is the input voltage to the first converter circuit 501 measured at the port "D" of the one or more second capacitors 503. A second trace comprises multiple pulses oscillating along a horizontal axis of time. The second trace records a voltage waveform at a port connecting the second inductor 505 and the second electronic switch 502 with respect to 0 VDC. In duration 702, the switching control signal turns on the second electronic switch 502 for 0.68 microseconds (μs), during which the second inductor 505 is charging up. Then, the switching control signal turns off the second electronic switch 502 for 1.9 μs in duration 703, during which the second inductor 505 is discharging. At a time 704, the second inductor 505 is discharged. A remaining energy left in the second inductor 505 is released via a path comprising a parasitic capacitance, producing ringing of three cycles 705, 706, and 707 before a next charging pulse starting at a time 708. In FIG. 2, a ringing frequency is around 389 kHz. A charging pulse duration 700 is measured to reflect the switching frequency of 100 kHz. In FIG. 2, a voltage amplitude 709 represents the output DC voltage in response to the dimmest dimming signal. The voltage amplitude 709 is greater than the minimum input operating voltage of the external LED luminaire 200 to operate thereof without flickering. The voltage amplitude 709 also produces a regulated output current proportional to an input rated current of the external LED luminaire 200 in response to the dimmest dimming signal.

Figure 3:
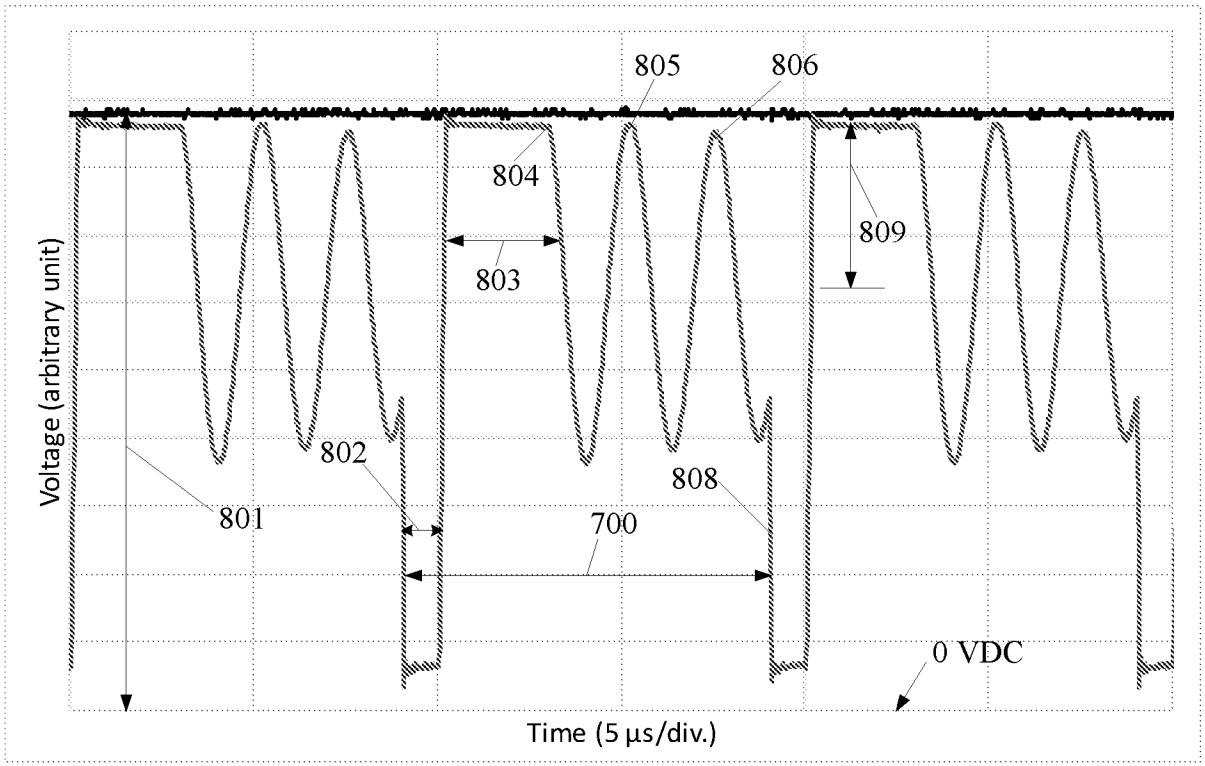
FIG. 3 is a second set of example waveforms measured at the second inductor according to the present disclosure.

FIG. 3 is a second set of example waveforms measured at the second inductor and the one or more second capacitors according to the present disclosure. As in FIG. 2, when the dimming signal corresponding to 4.9 VDC is present, the primary control circuit 650 sends the second PWM signal to the first converter circuit 501. The second transistor circuit 530 is configured to build up the switching control signal to turn on the second electronic switch 502 and to enable the first converter circuit 501 to generate the output DC voltage in response to the second PWM signal corresponding to the dimming signal of 4.9 VDC. In FIG. 3, a first trace having an amplitude 801 with respect to 0 VDC represents the first DC voltage, which is the input voltage to the first converter circuit 501 measured at the port "D" of the one or more second capacitors 503. A second trace comprises multiple pulses oscillating along a horizontal axis of time. The second trace records a voltage waveform at a port connecting the second inductor 505 and the second electronic switch 502 with respect to 0 VDC. In duration 802, the switching control signal turns on the second electronic switch 502 for 1.08 μs, during which the second inductor 505 is charging up. Then, the switching control signal turns off the second electronic switch 502 for 2.78 μs in duration 803, in which time the second inductor 505 is discharging. At a time 804, the second inductor 505 is discharged. A remaining energy left in the second inductor 505 is released via a path comprising a parasitic capacitance, producing a ringing of two cycles 805 and 806 before a next charging pulse starting at 808. In FIG. 3, a ringing frequency is around 389 kHz, same as in FIG. 2. A charging pulse duration 700 is measured to reflect the switching frequency of 100 kHz, same as in FIG. 2. As mentioned in depicting FIG. 1, the switching frequency is configured to operate at the predetermined value regardless the voltage level of the dimming signal. In FIG. 3, a voltage amplitude 809 represents the output DC voltage in response to the dimming signal corresponding to 4.9 VDC. The voltage amplitude 809 is greater than the voltage amplitude 709 in FIG. 2.

Figure 4:
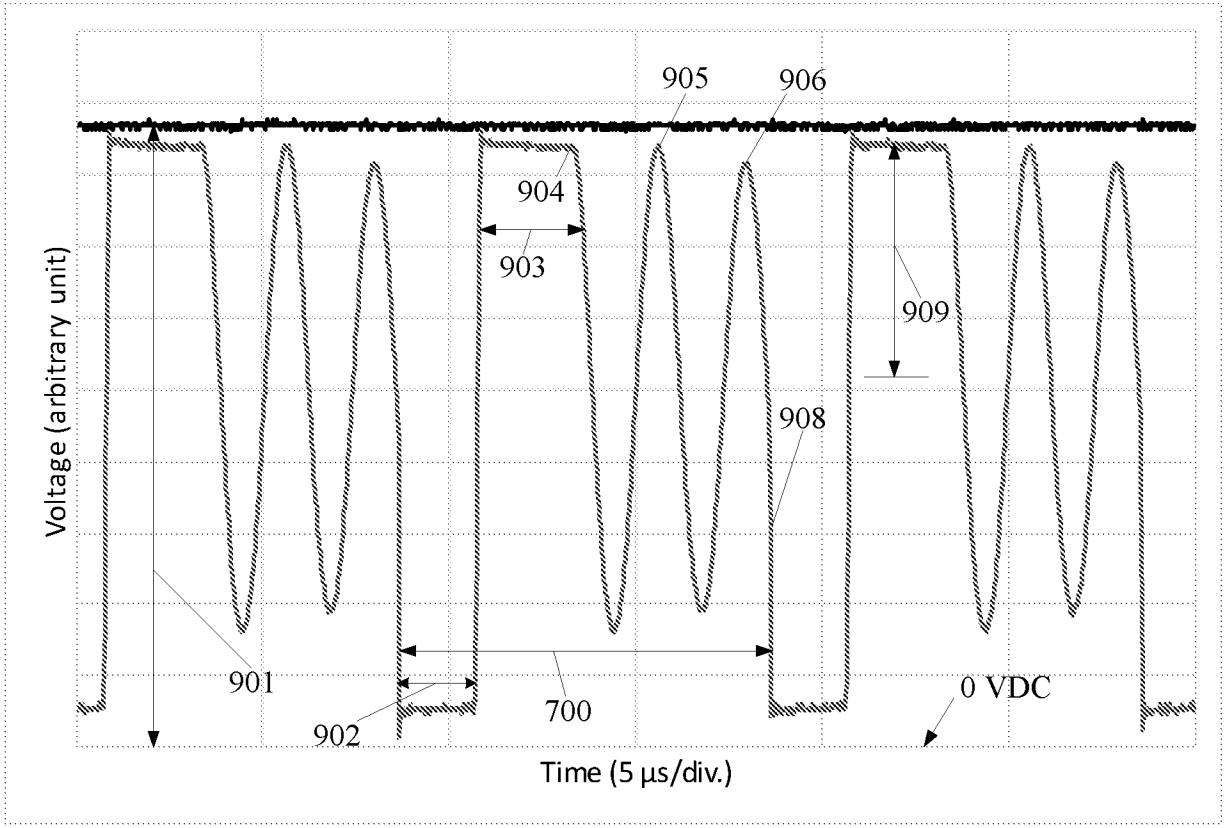
FIG. 4 is a third set of example waveforms measured at the second inductor according to the present disclosure.

FIG. 4 is a third set of example waveforms measured at the second inductor and the one or more second capacitors according to the present disclosure. As in FIG. 3, when the dimming signal corresponding to 8.8 VDC is present, the primary control circuit 650 sends the second PWM signal to the first converter circuit 501. The second transistor circuit 530 is configured to build up the switching control signal to turn on the second electronic switch 502 and to enable the first converter circuit 501 to generate the output DC voltage in response to the second PWM signal corresponding to the dimming signal of 8.8 VDC. In FIG. 4, a first trace having an amplitude 901 with respect to 0 VDC represents the first DC voltage, which is the input voltage to the first converter circuit 501 measured at the port "D" of the one or more second capacitors 503, same as in FIG. 2 and FIG. 3. A second trace comprises multiple pulses oscillating along a horizontal axis of time. The second trace records a voltage waveform at a port connecting the second inductor 505 and the second electronic switch 502 with respect to 0 VDC. In duration 902, the switching control signal turns on the second electronic switch 502 for 2.4 μs, during which the second inductor 505 is charging up. Then, the switching control signal turns off the second electronic switch 502 for 3.0 μs in duration 903, during which the second inductor 505 is discharging. At a time 904, the second inductor 505 is discharged. A remaining energy left in the second inductor 505 is released via a path comprising a parasitic capacitance, producing a ringing of two cycles 905 and 906 before a next charging pulse starting at 908. In FIG. 3, a ringing frequency is around 389 kHz, same as in FIG. 2 and FIG. 3. A charging pulse duration 700 is measured to reflect the switching frequency of 100 kHz, same as in FIG. 2 and FIG. 3. As mentioned in depicting FIG. 1, the switching frequency is configured to operate at the predetermined value regardless the voltage level of the dimming signal. In FIG. 4, a voltage amplitude 909 represents the output DC voltage in response to the dimming signal corresponding to 8.8 VDC. The voltage amplitude 909 is greater than the voltage amplitude 809 in FIG. 3.

Referring to FIGS. 1~4, the second electronic switch 502 is configured to modulate the first DC voltage at the switching frequency with on-time and off-time controlled by the switching control signal. The second inductor 505 is coupled to the second electronic switch 502 with current charging and discharging controlled by the second electronic switch 502. In other words, the second inductor 505 is further configured to be charged over the on-time and discharged over the off-time. Since an average current flowing from the second inductor 505 is equal to the regulated output current, the average current from the second inductor 505 yields to a luminaire driving current to drive the external LED luminaire 200. In contrast to detecting zero current in an output inductor in prior art, the switching control signal in this disclosure is used instead to control the second electronic switch 502 on and off with a duty cycle controlling the output DC voltage and the LED luminaire driving current. The duty cycle is thereby configured to regulate the output DC voltage to reach a voltage level equal to or greater than the minimum input operating voltage of the external LED luminaire 200.

Whereas a preferred embodiment of the present disclosure has been shown and described, it will be realized that alterations, modifications, and improvements may be made thereto without departing from the scope of the following claims. Another LED luminaire dimming drivers controllable by a low-voltage dimming controller to control an LED luminaire using various kinds of combinations to accomplish the same or different objectives could be easily adapted for use from the present disclosure. Accordingly, the foregoing descriptions and attached drawings are by way of example only and are not intended to be limiting.

What is claimed is:

1. A light-emitting diode (LED) luminaire dimming driver, comprising:

two electrical conductors configured to receive a line voltage from alternate-current (AC) mains;

a primary power supply circuit coupled to the two electrical conductors and configured to produce a first direct-current (DC) voltage;

an LED luminaire driving circuit comprising a first converter circuit and an optocoupler circuit configured to control the first converter circuit in response to a dimming signal from an external low-voltage dimming controller, wherein the LED luminaire driving circuit is configured to convert the first DC voltage into an output DC voltage with a regulated output current; and a supplied voltage control circuit comprising a relay switch comprising a coil, the relay switch configured to relay either the line voltage or the output DC voltage to an external LED luminaire to operate thereof, wherein:

the relay switch further comprises a first pair of input electrical terminals, a second pair of input electrical terminals, a third pair of input electrical terminals, and a pair of output electrical terminals;

the third pair of input electrical terminals are configured to receive a pick-up voltage to operate the coil;

the first pair of input electrical terminals are configured to receive the line voltage;

the second pair of input electrical terminals are configured to receive the output DC voltage;

the optocoupler circuit comprises an optocoupler comprising an infrared emitting diode and a phototransistor configured to receive optical signals emitting from the infrared emitting diode; and the optocoupler circuit is configured to operate in response to the dimming signal and also configured to subsequently enable the relay switch to relay the output DC voltage to the pair of output electrical terminals and to operate the external LED luminaire when the dimming signal is present.

2. The light-emitting diode (LED) luminaire dimming driver of claim 1, wherein the optocoupler circuit is further configured to produce a first pulse-width modulation (PWM) signal, wherein the supplied voltage control circuit further comprises a primary control circuit configured to produce both an analog signal and a second PWM signal in response to the first PWM signal, and wherein the second PWM signal is configured to control the first converter circuit.

3. The light-emitting diode (LED) luminaire dimming driver of claim 2, wherein the optocoupler circuit further comprises an interface circuit configured to receive the dimming signal and to communicate with the primary control circuit via the optocoupler.

4. The light-emitting diode (LED) luminaire dimming driver of claim 2, wherein the supplied voltage control circuit further comprises a first transistor circuit configured to receive the analog signal and to control the pick-up voltage to appear at the third pair of input electrical terminals.

5. The light-emitting diode (LED) luminaire dimming driver of claim 2, wherein the first converter circuit is further configured to produce the output DC voltage with the regulated output current proportional to an input rated current of the external LED luminaire in response to the dimming signal.

6. The light-emitting diode (LED) luminaire dimming driver of claim 2, wherein the primary power supply circuit comprises a second converter circuit configured to produce the first DC voltage higher than a maximum input operating voltage of the second converter circuit, and wherein the first converter circuit is configured to receive both the first DC voltage and the second PWM signal and to regulate the output DC voltage less than the first DC voltage with the regulated output current to operate the external LED luminaire in response to the second PWM signal.

7. The light-emitting diode (LED) luminaire dimming driver of claim 6, wherein the second converter circuit comprises a first electronic switch, one or more first capacitors, one or more first switching diodes, and a first inductor connecting in front of the first electronic switch, and wherein the first electronic switch is configured to turn on and off to respectively charge and discharge the first inductor and to regulate the first DC voltage.

8. The light-emitting diode (LED) luminaire dimming driver of claim 6, wherein the first converter circuit is further configured to regulate the output DC voltage equal to or greater than a minimum input operating voltage of the external LED luminaire to operate thereof when the dimming signal is present.

9. The light-emitting diode (LED) luminaire dimming driver of claim 2, wherein, each time when the dimming signal is changed, the relay switch is controlled to deliver the output DC voltage to operate the external LED luminaire in response to the dimming signal.

10. The light-emitting diode (LED) luminaire dimming driver of claim 2, wherein the first converter circuit comprises a second electronic switch, one or more second capacitors, one or more second switching diodes, and a second inductor connecting between the one or more second capacitors and the second electronic switch, and wherein the second electronic switch is configured to turn on and off to respectively charge and discharge the second inductor and to regulate the output DC voltage with the regulated output current to operate the external LED luminaire with a dimmable output light.

11. The light-emitting diode (LED) luminaire dimming driver of claim 10, wherein the second electronic switch is further configured to be turned on according to a pulse width of the second PWM signal and a switching frequency.

12. The light-emitting diode (LED) luminaire dimming driver of claim 11, wherein the pulse width of the second PWM signal comprises a range of pulse widths from a narrowest pulse width to a widest pulse width all proportional to a voltage level of the dimming signal, and wherein the narrowest pulse width is in response to a dimming signal that produces a dimmest lighting luminance.

13. The light-emitting diode (LED) luminaire dimming driver of claim 10, wherein the switching frequency is configured to operate at a predetermined value.

14. The light-emitting diode (LED) luminaire dimming driver of claim 10, wherein the first converter circuit further comprises a second transistor circuit comprising one or more second transistors configured to build up a switching control signal to turn on the second electronic switch and to enable the first converter circuit when the dimming signal is present, thereby producing the output DC voltage in response to the second PWM signal.

15. The light-emitting diode (LED) luminaire dimming driver of claim 14, wherein the LED luminaire dimming driver further comprises a secondary power supply circuit configured to down-convert the first DC voltage into a second DC voltage to supply a power to the pick-up voltage and to build up the switching control signal.

16. The light-emitting diode (LED) luminaire dimming driver of claim 15, wherein the LED luminaire dimming driver further comprises a tertiary power supply circuit configured to down-convert the second DC voltage into a third DC voltage to supply a power to the primary control circuit and the optocoupler, thereby sustaining the analog signal, the first PWM signal, and the second PWM signal.

17. The light-emitting diode (LED) luminaire dimming driver of claim 16, wherein the one or more second transistors are further configured to up-convert the second PWM signal received into the switching control signal with an amplitude close to the second DC voltage, thereby expediting switching of the second electronic switch and producing the output DC voltage in response to the switching control signal.

18. The light-emitting diode (LED) luminaire dimming driver of claim 7, wherein the primary power supply circuit further comprises a third inductor magnetically coupled to the first inductor but electrically isolated from the first inductor, and wherein the third inductor is configured to set up a fourth DC voltage to supply a power to the interface circuit and the infrared emitting diode, thereby allowing transmission of the dimming signal between the external low-voltage dimming controller and the primary control circuit and maintaining a circuit isolation thereof.

19. The light-emitting diode (LED) luminaire dimming driver of claim 18, wherein the fourth DC voltage is built up with a current flowing through the infrared emitting diode, thereby transferring a high-level voltage signal with the first PWM signal to the phototransistor, and wherein the high-level voltage signal enables the primary control circuit, thereby operating the first converter circuit and the coil.

20. The light-emitting diode (LED) luminaire dimming driver of claim 1, wherein the dimming signal received from the external low-voltage dimming controller comprises either a nominal 0-to-10-volt signal or a nominal 1-to-10-volt signal.

* * * * *